US009609948B2

(12) United States Patent
Qi et al.

(10) Patent No.: US 9,609,948 B2
(45) Date of Patent: Apr. 4, 2017

(54) ROTATING ARMREST APPARATUS

(71) Applicant: Qianglong Furniture Co., Ltd., Huzhou, Zhejiang (CN)

(72) Inventors: Zhiqiang Qi, Huzhou (CN); Yong Chern Ng, Huzhou (CN)

(73) Assignee: QIANGLONG FURNITURE CO., LTD., Huzhou (CN)

( * ) Notice: Subject to any disclaimer, the term of this patent is extended or adjusted under 35 U.S.C. 154(b) by 0 days.

(21) Appl. No.: 14/697,628

(22) Filed: Apr. 28, 2015

(65) Prior Publication Data

US 2016/0316917 A1 Nov. 3, 2016

(51) Int. Cl.

| | |
|---|---|
| ***A47C 7/54*** | (2006.01) |
| ***B60N 2/46*** | (2006.01) |
| ***A47C 1/03*** | (2006.01) |

(52) U.S. Cl.

CPC ..... *A47C 1/03* (2013.01); *B60N 2/4626* (2013.01); *B60N 2/46* (2013.01); *B60N 2/4633* (2013.01)

(58) Field of Classification Search

CPC ..... B60N 2/4633; B60N 2/46; B60N 2/4626; A47C 1/03

USPC ..... 297/411.2, 411.35, 411.36, 411.38, 297/411.39

See application file for complete search history.

(56) References Cited

U.S. PATENT DOCUMENTS

| | | | | |
|---|---|---|---|---|
| 5,407,249 | A * | 4/1995 | Bonutti | A47B 21/0371 248/118 |
| 5,839,786 | A * | 11/1998 | Cvek | A47C 1/03 297/411.35 |
| 6,076,891 | A * | 6/2000 | Bernhardt | A47C 1/03 297/411.31 |
| 7,533,939 | B2 * | 5/2009 | Fookes | A47C 1/03 297/353 |
| 7,828,389 | B2 * | 11/2010 | Oda | A47C 1/03 297/411.35 |
| 8,967,724 | B2 * | 3/2015 | Battey | A47C 1/032 297/411.35 |
| 2002/0043863 | A1 * | 4/2002 | Roslund, Jr. | A47C 1/03 297/411.36 |
| 2003/0030317 | A1 * | 2/2003 | Chen | A47C 1/03 297/411.35 |
| 2014/0312669 | A1 * | 10/2014 | Zheng | B64D 11/00 297/354.1 |

* cited by examiner

*Primary Examiner* — Chi Q Nguyen

(57) ABSTRACT

A rotating armrest apparatus includes a handle, a rotating device disposed at one end of the handle, an elevation adjustment device disposed at another end of the handle, and a rotatable armrest disposed on top of the elevation adjustment device.

4 Claims, 6 Drawing Sheets

ROTATING ARMREST APPARATUS

TECHNICAL BACKGROUND

The present application is directed to an armrest apparatus for chairs. In particular, it is directed to a rotating armrest apparatus.

BACKGROUND

Limitations are found at armrests for chairs in the prior art. The rotating part disposed between the fixing base and the handle fails to enable vertical position adjustment and rotation of the armrests. Due to the limitations above, armrests of chairs can hardly cater for the habits of different people.

SUMMARY

With respect to the above imperfections, the present application proposes a rotating armrest apparatus.

The present application provides a rotating armrest apparatus, including:

a handle;

a rotating device disposed at one end of the handle;

an elevation adjustment device disposed at another end of the handle; and a rotatable armrest disposed at the elevation adjustment device.

The rotating armrest apparatus may further include:

an armrest fixation sheet;

a decorative cover for the armrest fixation sheet; and a groove disposed on a lower side of the decorative cover; wherein:

the rotating device comprises a rotary pivot fixated on an upper side of the decorative cover; and the armrest fixation sheet is fixed with the decorative cover by inserting the groove.

The rotating armrest apparatus may further include:

a slotted hole disposed on a side of the rotary pivot;

a rotary positioning knob disposed at the slotted hole and capable of restoration of position through a rotary elastic spring; wherein when an external force is exerted on the rotary positioning knob, the rotary pivot is rotatable, and when the rotary elastic spring restores, the rotary pivot undergoes positioning.

The rotating armrest apparatus may further include:

a decorative cover fixation member disposed at an arm of the handle;

slots disposed at both ends of the decorative cover fixation member;

an armrest decorative cover configured to cooperate with the decorative cover fixation member;

buckles disposed at the armrest decorative cover; wherein the armrest decorative cover is fixed with the handle by engagement of the slots and the buckles.

The elevation adjustment device may include an armrest elevation lever; horizontal tightness control members wrapping both sides of the armrest elevation lever;

an armrest elevation regulator inserted into an interior side of the armrest elevation lever;

at least one positioning hole for positioning the armrest elevation lever disposed at an interior side of the horizontal tightness control members;

a regulator restoration spring disposed at a top of the armrest elevation regulator; and a cover positioning member fixated on an upper end of the armrest elevation lever; wherein the regulator restoration spring supports the cover positioning member.

The rotatable armrest may include:

a cover;

a movable cover that allows forward and backward movements and is fixed with the cover;

a rotation adjustment cover disposed at an interior of the movable cover and fixed at the cover positioning member;

a rotation fixing member disposed on an interior side of the rotation adjustment cover and fixed at the cover positioning member; the rotation adjustment cover being limitedly movable relative to the rotation fixing member;

rotation adjustment knobs disposed at both sides of the rotation fixing member and capable of restoration of position via rotation positioning springs;

at least one set of adjustment grooves disposed at an interior of the rotation adjustment cover and configured to cooperate with the rotation adjustment knob; and the rotation adjustment knobs are insertable into the adjustment grooves successively under elastic effect of the rotation positioning spring, thereby enabling rotation positioning and enabling entire horizontal movement of the cover after the rotation positioning.

DETAILED DESCRIPTION

The rotating armrest apparatus according to the embodiments of the present application will be described below in detail with reference to the drawings.

Figure 1:
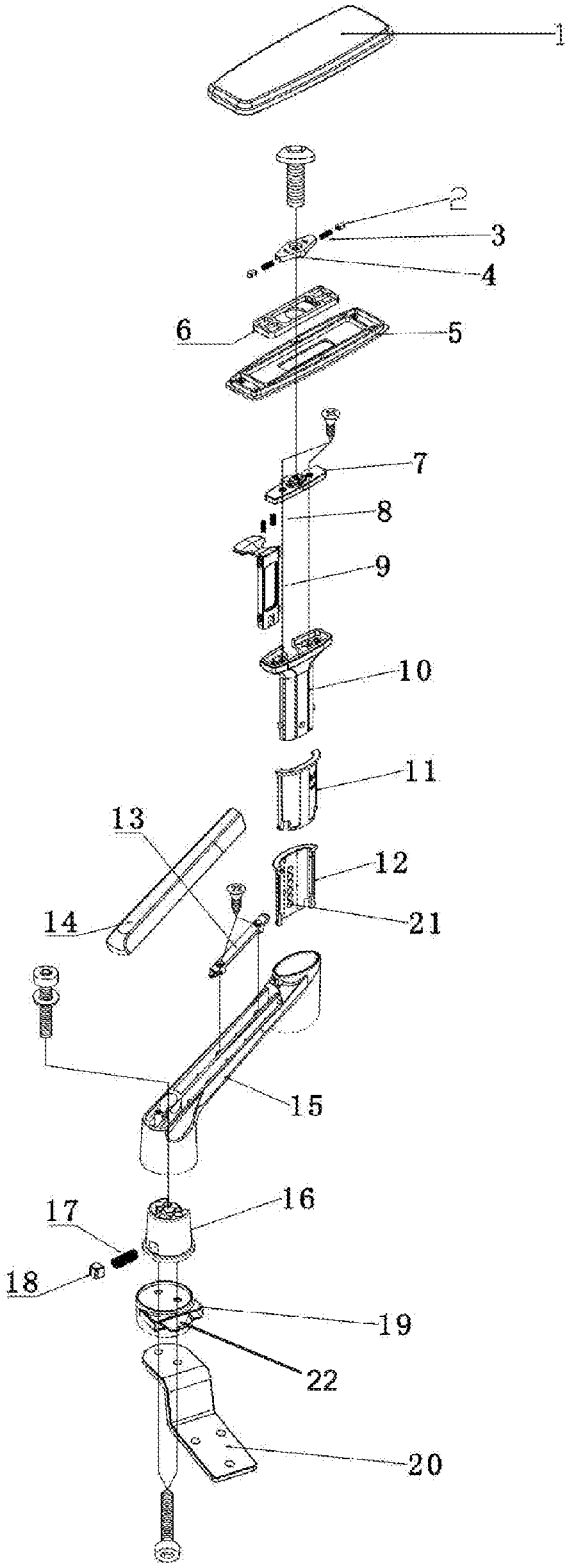
FIG. 1 is the explosion view of the rotating armrest apparatus of the present application.
Figure 2:
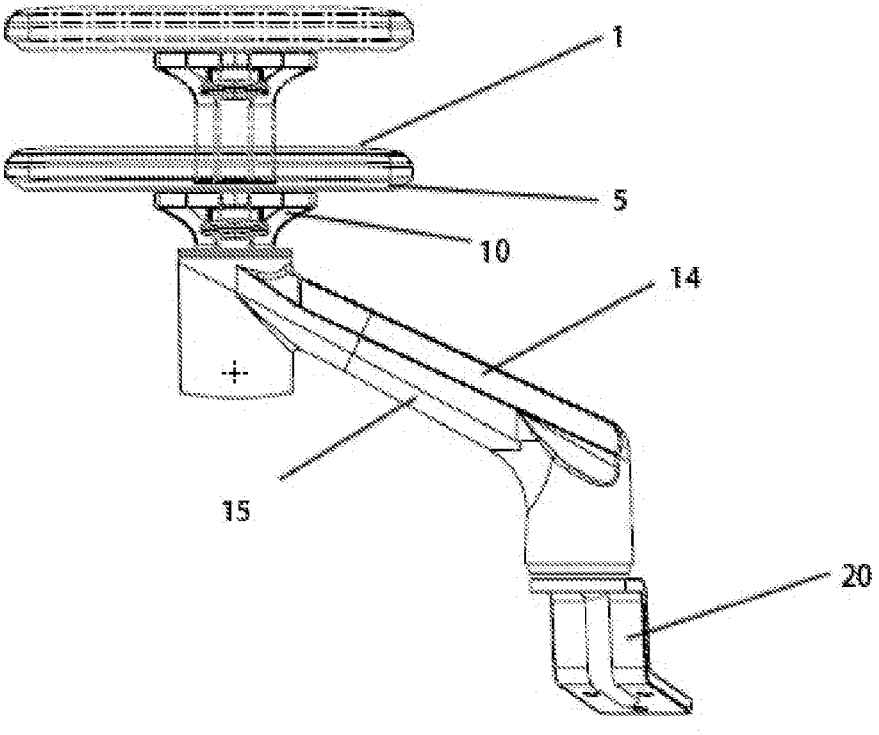
FIG. 2 illustrates the elevation of the armrest of the present application.
Figure 3:
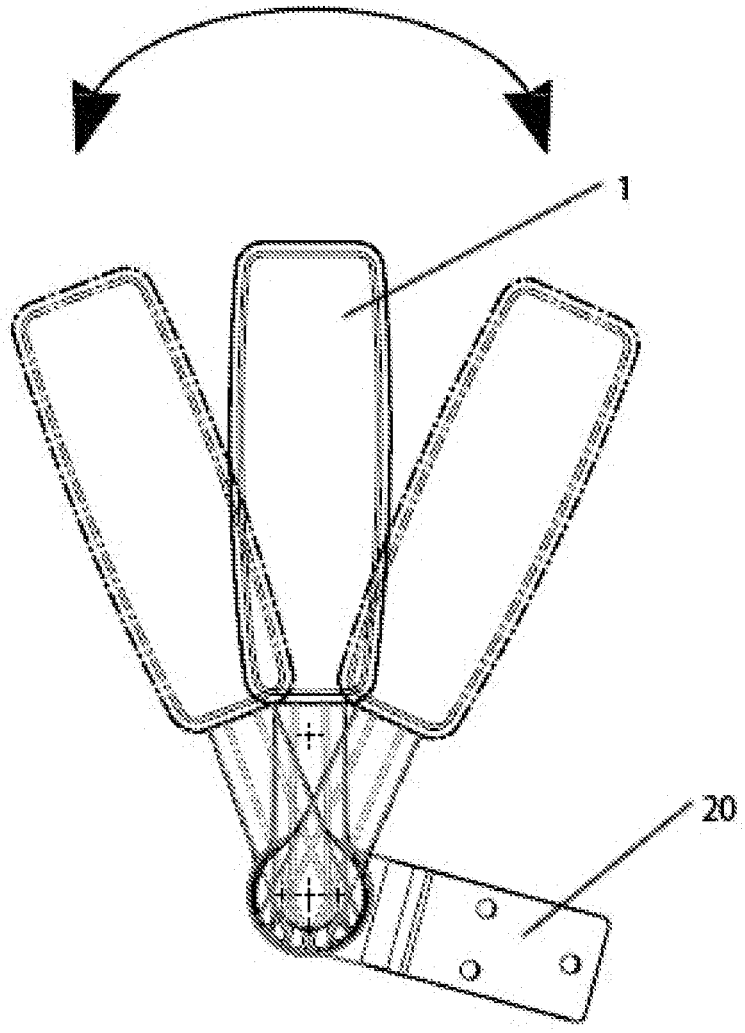
FIG. 3 illustrates the rotation of the handle of the present application.
Figure 4:
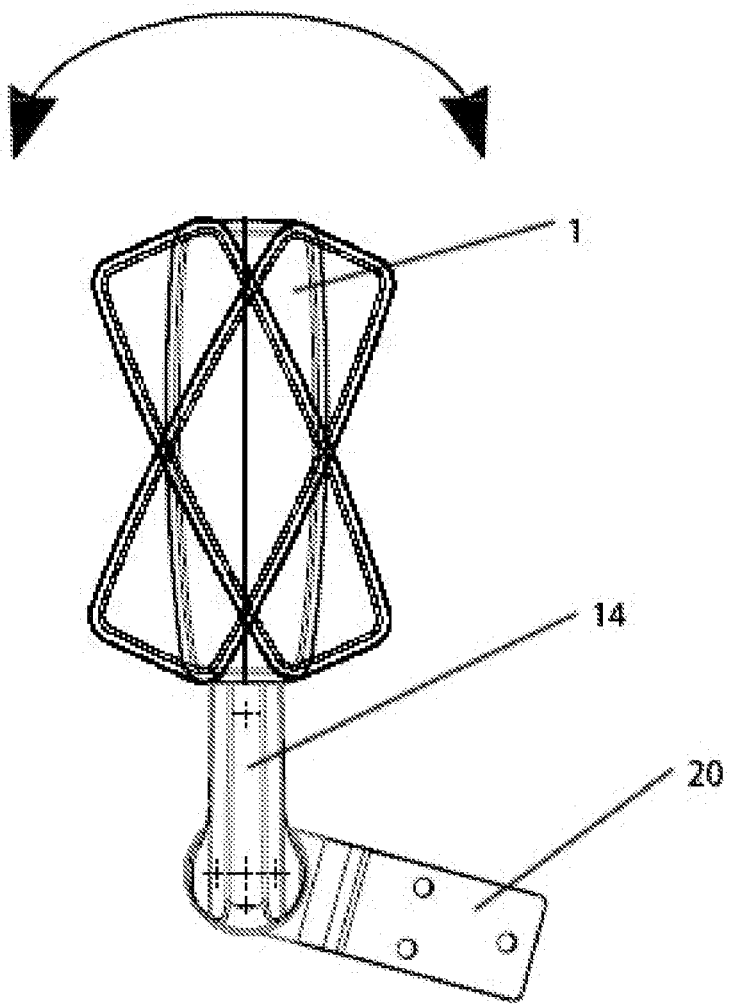
FIG. 4 illustrates the rotation of the armrest of the present application.
Figure 5:
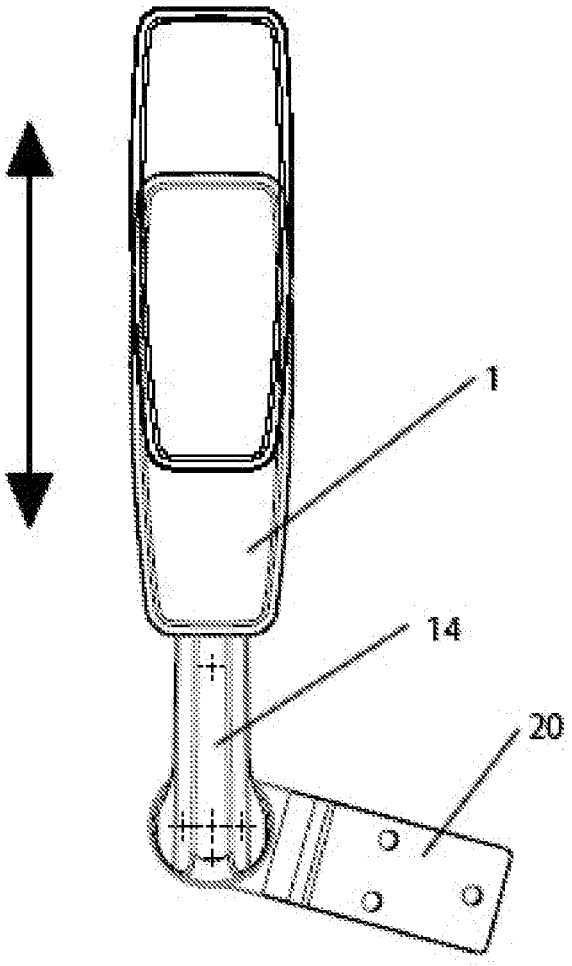
FIG. 5 illustrates the horizontal movement of the armrest of the present application.
Figure 6:
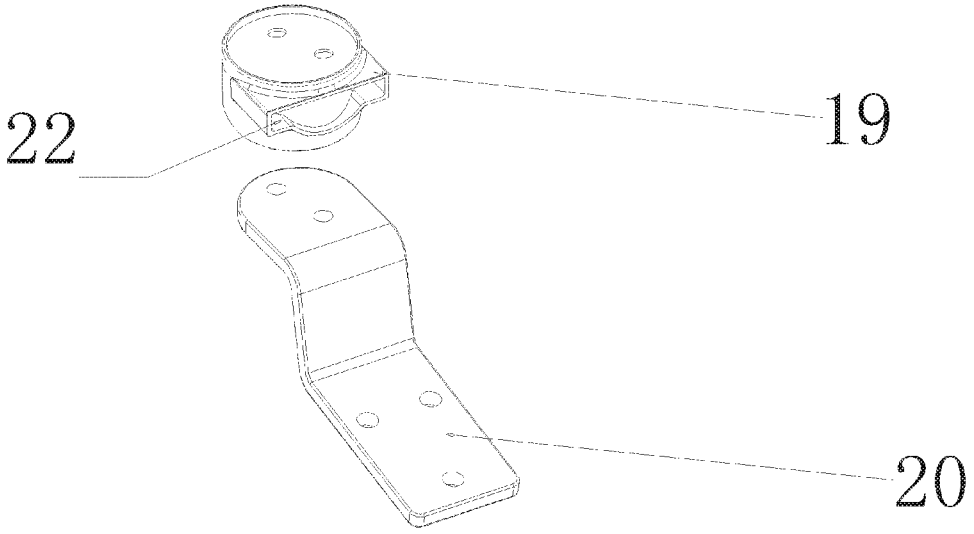
FIG. 6 is an enlarged view of the groove and the armrest fixation sheet illustrated in FIG. 1.

A rotating armrest apparatus in FIGS. 1-6 includes a handle, a rotating device disposed at one end of the handle, an elevation adjustment device disposed at another end of the handle, and a rotatable armrest disposed at the elevation adjustment device. The rotating device includes a rotary pivot 16 fixated on the upper side of a decorative cover 19 of an armrest fixation sheet, which includes a groove 22 on the lower side. The armrest fixation sheet 20 inserts into the groove 22 and becomes fixed with the decorative cover 19 of the armrest fixation sheet. The rotary pivot includes a slotted hole on a side, where a rotary positioning knob 18 is disposed. The rotary positioning knob 18 undergoes restoration of position through a rotary elastic spring 17. When an external force is exerted on the rotary positioning knob 18, the rotary positioning knob 18 inserts into the rotary pivot 16 and the rotary pivot 16 becomes rotatable. When the rotary elastic spring 17 restores, the rotary pivot 16 undergoes positioning and the rotation of the rotary pivot 16 is limited.

On the arm of the handle 15, a decorative cover fixation member 13 is disposed, at both ends of which slots are disposed. Buckles are disposed at an armrest decorative cover 14 configured to cooperate with the decorative cover fixation member 13 in order to fix the armrest decorative cover 14 onto the handle 15 by engagement of the slots and the buckles.

The elevation adjustment device includes an armrest elevation lever 10, both sides of which are wrapped by horizontal tightness control members (11, 12). An armrest elevation regulator 9 is inserted onto the interior side of the armrest elevation lever 10. At least one positioning hole 21 for positioning the armrest elevation lever 10 is disposed on the interior side of the horizontal tightness control member (11, 12). A regulator restoration spring 8 is disposed at the top of the armrest elevation regulator 9. A cover positioning member 7 is fixated at the upper end of the armrest elevation lever 10. The regulator restoration spring 8 supports the cover positioning member 7.

The rotating armrest includes a cover 1 and a movable cover 5 that allows forward and backward movements. A rotation adjustment cover 6 is disposed at the interior of the movable cover 5. A rotation fixing member 4 is disposed on the interior side of the rotation adjustment cover 6. The rotation fixing member 4 and the rotation adjustment cover 6 are fixated on the cover positioning member 7 with screws. The rotation adjustment cover 6 is rotatable relative to the rotation fixing member 4 and can move back and forth. Rotation adjustment knobs 2 are disposed at both sides of the rotation fixing member 4, allowing restoration of position via rotation positioning springs 3. At least one set of adjustment grooves are disposed at the interior of the rotation adjustment cover 6 and configured to cooperate with the rotation adjustment knob 2. The rotation adjustment knobs 2 insert into the grooves successively under the elastic effect of the rotation positioning springs 3, thereby enabling rotation positioning. After rotation positioning, the whole cover can drive the horizontal movement of the rotation adjustment cover 6. Since the rotation fixing member 4 is fixated on the cover positioning member 7, restoration can be realized under the influence of the rotation positioning spring 3 and the rotation adjustment cover 6.

The advantages of the present application include: through the rotation device, the elevation adjustment device and the rotatable armrest, rotation of the handle, elevation of the armrest, rotation and forward and backward movements of the armrest are realized. Adjustment to the armrest apparatus is allowed to a larger extent, thereby catering for postures of every user and resulting in enhanced comfort.

The above describes only the preferred embodiment of the present application. It should be noted that the skilled in the art are able to make improvements and variations without deviating the idea of the present application. Such improvements and variations should be deemed to be within the protection scope of the present application.

What is claimed is:

1. A rotating armrest apparatus, comprising:
a handle;
a rotating device disposed at one end of the handle;
an elevation adjustment device disposed at another end of the handle; and
a rotatable armrest disposed on top of the elevation adjustment device;
the apparatus further comprising:
an armrest fixation sheet;
a decorative cover for the armrest fixation sheet; and
a groove disposed on a lower side of the decorative cover; wherein:
the rotating device comprises a rotary pivot fixated on an upper side of the decorative cover;
and the armrest fixation sheet is fixed with the decorative cover by inserting the groove.

2. The rotating armrest apparatus according to claim 1, further comprising:
a slotted hole disposed on a side of the rotary pivot;
a rotary positioning knob disposed at the slotted hole and capable of restoration of position through a rotary elastic spring; wherein
when an external force is exerted on the rotary positioning knob, the rotary pivot is rotatable, and when the rotary elastic spring restores, the rotary pivot undergoes positioning.

3. The rotating armrest apparatus according to claim 1, wherein:
the elevation adjustment device comprises an armrest elevation lever;
horizontal tightness control members wrapping both sides of the armrest elevation lever;
an armrest elevation regulator inserted into an interior side of the armrest elevation lever;
at least one positioning hole for positioning the armrest elevation lever disposed at an interior side of the horizontal tightness control members;
a regulator restoration spring disposed at a top of the armrest elevation regulator; and
a cover positioning member fixated on an upper end of the armrest elevation lever; wherein the regulator restoration spring supports the cover positioning member.

4. The rotating armrest apparatus according to claim 3, wherein:
the rotatable armrest comprises:
a cover;
a movable cover that allows forward and backward movements and is fixed with the cover;
a rotation adjustment cover disposed at an interior of the movable cover and fixed at the cover positioning member;
a rotation fixing member disposed on an interior side of the rotation adjustment cover and fixed at the cover positioning member; the rotation adjustment cover being limitedly movable relative to the rotation fixing member;
rotation adjustment knobs disposed at both sides of the rotation fixing member and capable of restoration of position via rotation positioning springs;
at least one set of adjustment grooves disposed at an interior of the rotation adjustment cover and configured to cooperate with the rotation adjustment knob; and
the rotation adjustment knobs are insertable into the adjustment grooves successively under elastic effect of the rotation positioning spring, thereby enabling rotation positioning and enabling entire horizontal movement of the cover after the rotation positioning.

* * * * *